US010145157B2

(12) United States Patent
White

(10) Patent No.: US 10,145,157 B2
(45) Date of Patent: Dec. 4, 2018

(54) BREAKAWAY HINGE RECEPTACLE

(71) Applicant: Mansfield Engineered Components, Inc., Mansfield, OH (US)

(72) Inventor: Brian White, Shelby, OH (US)

(73) Assignee: Mansfield Engineered Components, Inc., Mansfield, OH (US)

( * ) Notice: Subject to any disclaimer, the term of this patent is extended or adjusted under 35 U.S.C. 154(b) by 0 days.

(21) Appl. No.: 14/170,549

(22) Filed: Jan. 31, 2014

(65) Prior Publication Data

US 2014/0208542 A1 Jul. 31, 2014

Related U.S. Application Data

(60) Provisional application No. 61/759,002, filed on Jan. 31, 2013.

(51) Int. Cl.
*F24C 15/02* (2006.01)
*E05D 7/12* (2006.01)

(52) U.S. Cl.
CPC ..... *E05D 7/12* (2013.01); *F24C 15/023* (2013.01); *E05Y 2800/404* (2013.01); *E05Y 2800/406* (2013.01); *E05Y 2900/30* (2013.01); *Y10T 16/53605* (2015.01)

(58) Field of Classification Search
CPC ..... E05F 1/1261; E05F 1/12; E05F 1/1246; E05F 1/1253; E05F 1/08; E05D 5/06; E05D 5/065; E05D 7/0407; E05D 7/06; E05D 7/12; E05D 7/123; Y10T 16/529; Y10T 16/538; Y10T 16/5383; Y10T 16/53838; F24C 15/02; F24C 15/023
USPC ..... 16/233, 286, 289, 292
See application file for complete search history.

(56) References Cited

U.S. PATENT DOCUMENTS

| | | | | |
|---|---|---|---|---|
| 3,067,736 | A | | 12/1962 | Barefoot |
| 3,503,380 | A | * | 3/1970 | Vasaturo ..... 126/191 |
| 3,712,287 | A | * | 1/1973 | Summers, Jr. ..... 126/191 |
| 3,955,865 | A | | 5/1976 | Wilson |
| 4,001,973 | A | | 1/1977 | Rice et al. |
| 4,194,321 | A | | 3/1980 | Hess |
| 4,315,495 | A | | 2/1982 | Jellies |
| 4,665,892 | A | | 5/1987 | Spargo et al. |
| 5,291,634 | A | * | 3/1994 | Zanetti ..... 16/333 |
| 5,341,542 | A | | 8/1994 | Hannan et al. |

(Continued)

*Primary Examiner* — Emily M Morgan
(74) *Attorney, Agent, or Firm* — Fay Sharpe LLP

(57) ABSTRACT

A receptacle for an associated appliance hinge includes a receptacle base and a breakaway lever movably connected to the receptacle base. The breakaway lever includes a cam edge. A first mounting structure is connected to the receptacle base and adapted to be engaged by an associated hinge arm. A second mounting structure connected to the breakaway lever such that the second mounting structure is movable relative to the receptacle base. The second mounting structure is adapted to be engaged by the associated hinge arm. A breakaway latch is connected to the base and includes a cam follower engaged with the cam edge. The breakaway latch further includes a spring that biases the cam follower into abutment with the cam edge. The breakaway lever is selectively movable from a first position where the cam follower is engaged with a first location on the cam edge to a second position where the cam follower is engaged with a second location on the cam edge.

9 Claims, 10 Drawing Sheets

(56) References Cited

U.S. PATENT DOCUMENTS

| | | | | |
|---|---|---|---|---|
| 5,937,481 | A | 8/1999 | Faringosi | |
| 6,892,424 | B1 | 5/2005 | Habegger et al. | |
| 7,017,232 | B1 | 3/2006 | Priddy | |
| 7,150,071 | B2 | 12/2006 | Collene et al. | |
| 8,201,304 | B2 * | 6/2012 | Steurer et al. | 16/286 |
| 8,307,504 | B2 * | 11/2012 | Collene | 16/286 |
| 8,533,914 | B2 * | 9/2013 | Vanini | 16/286 |
| 2005/0015927 | A1 * | 1/2005 | Kropf | 16/286 |
| 2006/0032019 | A1 | 2/2006 | Kistner et al. | |
| 2010/0212112 | A1 * | 8/2010 | Steurer et al. | 16/286 |
| 2013/0067685 | A1 | 3/2013 | Collene | |
| 2014/0150212 | A1 * | 6/2014 | Collene et al. | 16/286 |
| 2014/0208542 | A1 * | 7/2014 | White | 16/261 |

* cited by examiner

BREAKAWAY HINGE RECEPTACLE

CROSS-REFERENCE TO RELATED APPLICATION

This application claims priority from and benefit of the filing date of U.S. provisional application Ser. No. 61/759,002 filed Jan. 31, 2013, and the entire disclosure of said provisional application is hereby expressly incorporated by reference into the present specification.

BACKGROUND

Oven, dryer, and other appliance manufacturers sometimes desire to equip the appliance with a "breakaway" hinge system such that excessive weight placed on the open door of the appliance will cause the door to "breakaway" or collapse such that the door moves beyond its fully opened (approximately horizontal) position rather than cause damage to the hinge system and/or cause the entire appliance to tip. In some cases, a stop is provided to limit breakaway movement and in others the door is allowed to pivot until it contacts the floor or other support surface supporting the appliance. Depending upon the exact design of the breakaway mechanism, the door breakaway condition can self-reset such that removal of the excessive weight from the appliance door will allow the door to return to its operative opened position (so as to lie in a plane that is approximately horizontal), or the door breakaway condition can be made persistent and thus require a manual reset of the breakaway mechanism by the appliance user or a service technician before the appliance door is again ready for use.

Known appliance door breakaway systems have been deemed to be sub-optimal for a wide variety of reasons, including cost, complexity, performance, size, and the like. As such, it has been deemed desirable to provide a new appliance door breakaway system that overcomes the above-noted deficiencies and others associated with known systems.

SUMMARY

In accordance with one aspect of the present development, a receptacle for an associated appliance hinge includes a receptacle base and a breakaway lever movably connected to the receptacle base. The breakaway lever includes a cam edge. A first mounting structure is connected to the receptacle base and adapted to be engaged by an associated hinge arm. A second mounting structure connected to the breakaway lever such that the second mounting structure is movable relative to the receptacle base. The second mounting structure adapted to be engaged by the associated hinge arm. A breakaway latch is connected to the base and includes a cam follower engaged with the cam edge. The breakaway latch further includes a spring that biases the cam follower into abutment with the cam edge. The breakaway lever is selectively movable from a first position where the cam follower is engaged with a first location on the cam edge to a second position where the cam follower is engaged with a second location on the cam edge.

DETAILED DESCRIPTION

Figure 1:
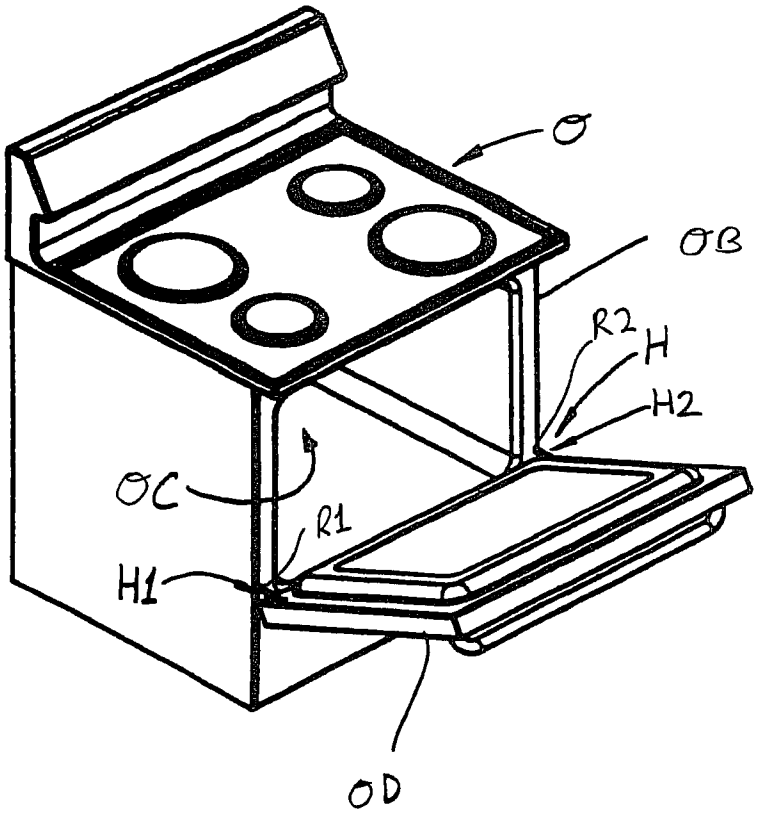
FIG. 1 is an isometric view of an appliance including first and second breakaway hinge receptacles provided in accordance with the present development.

FIG. 1 shows an appliance O comprising a body OB that defines a hollow chamber OC that opens through a face of the body OB. A door OD is connected to the body OB by first and second hinge assemblies H1,H2 located on opposite lateral sides of the door OD. The first and second hinge assemblies are releasably connected to the appliance body OB via respective first and second breakaway receptacles R1,R2 that are mounted on the body OB adjacent opposite sides of the chamber OC. Each hinge assembly H1,H2 is conventional and can take many different forms and can engage with the receptacle R1,R2 in different ways, provided that each hinge assembly H1,H2 mates with and engages the receptacle R1,R2 in a manner that enables operation of the breakaway receptacle R1,R2 as described below. As shown herein, both the first and second receptacles R1,R2 are breakaway receptacles provided in accordance with the present development but, alternatively, the appliance O can comprise only one of the breakaway receptacles R1,R2, with the other receptacle R1,R2 being a different type of breakaway receptacle. The appliance O is shown as an oven, but it could alternatively be clothes dryer, clothes washer, or any other type of appliance.

Figure 2B:
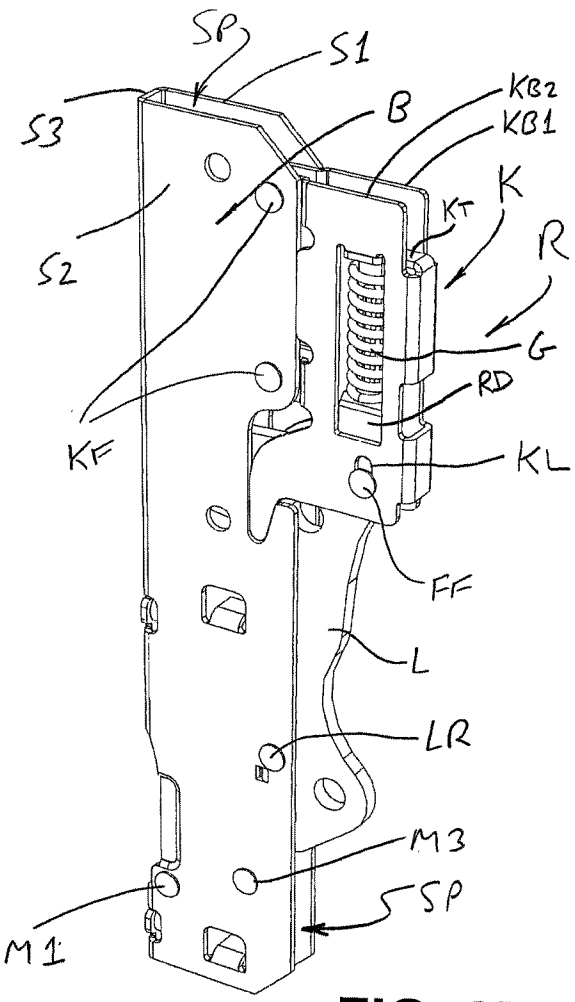
FIGS. 2A & 2B are respective front and rear isometric views of a breakaway hinge receptacle provided in accordance with the present development.
Figure 2A:
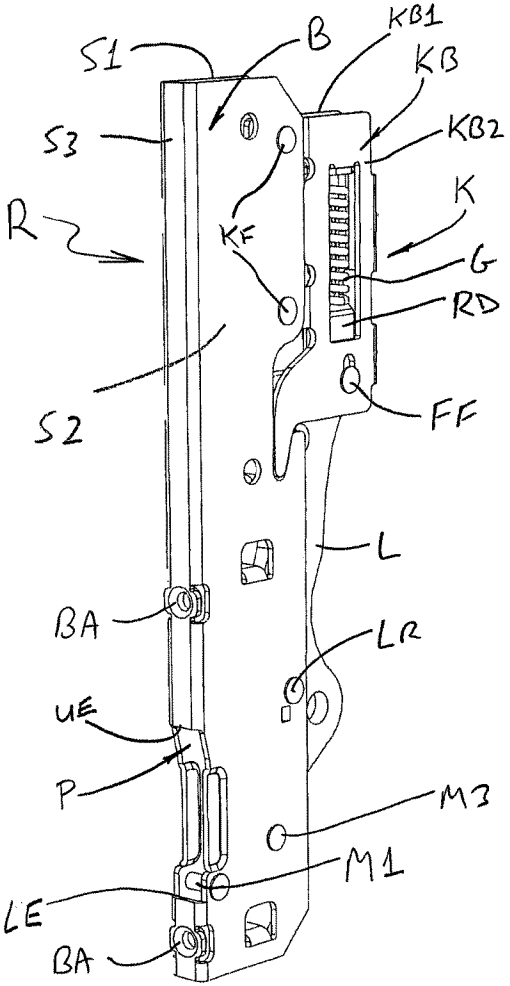

FIGS. 2A & 2B are front and rear isometric views that show an embodiment of a breakaway hinge receptacle R1,R2 (generally referred to using the identifier "R") provided in accordance with the present development. The receptacle R includes a base B comprising first and second side walls S1,S2 connected by a front wall S3 so as to define a U-shaped cross-section with an open recess or space SP defined between the first and second side walls S1,S2 and front wall S3. In one embodiment, the base B comprises a one-piece metal part comprising U-shaped cross-section. The front wall S3 or other part of the base includes one or more apertures BA used for fastening the base B to an associated appliance frame/chassis/body (such as the appliance body OB of FIG. 1) via associated rivets or other fasteners inserted therethrough, and/or the base B can be welded or otherwise fixedly secured to the appliance body OB. Part or all of one of the base side walls S1,S2 can be omitted, and the base B need not have a U-shaped cross-section as shown.

Figure 3A:
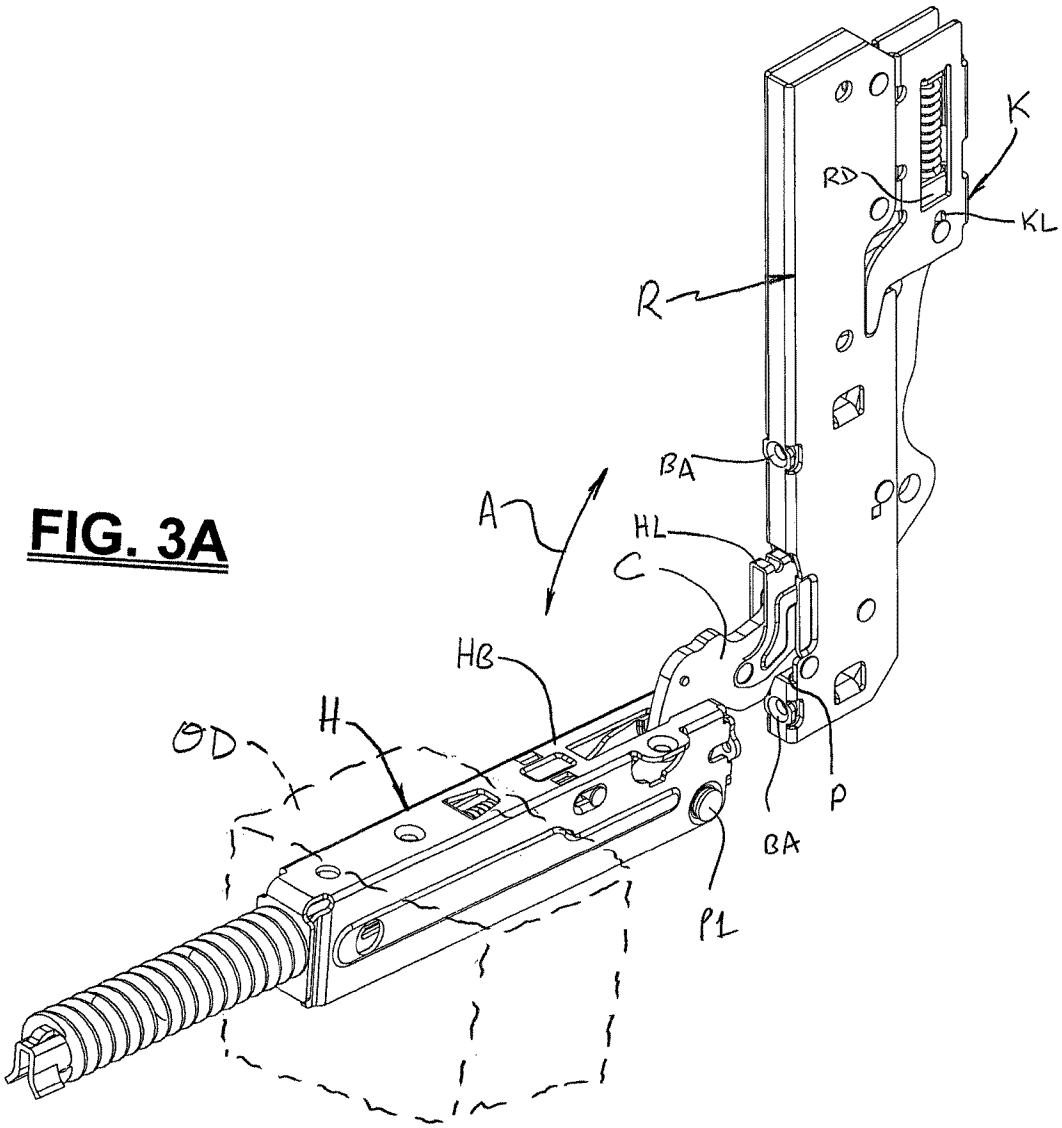
FIG. 3A is a front isometric view that shows the breakaway receptacle of FIG. 2A and an associated hinge assembly mated therewith, with the hinge assembly is shown in a door-opened position and the breakaway receptacle shown in its normal operative position.
Figure 3B:
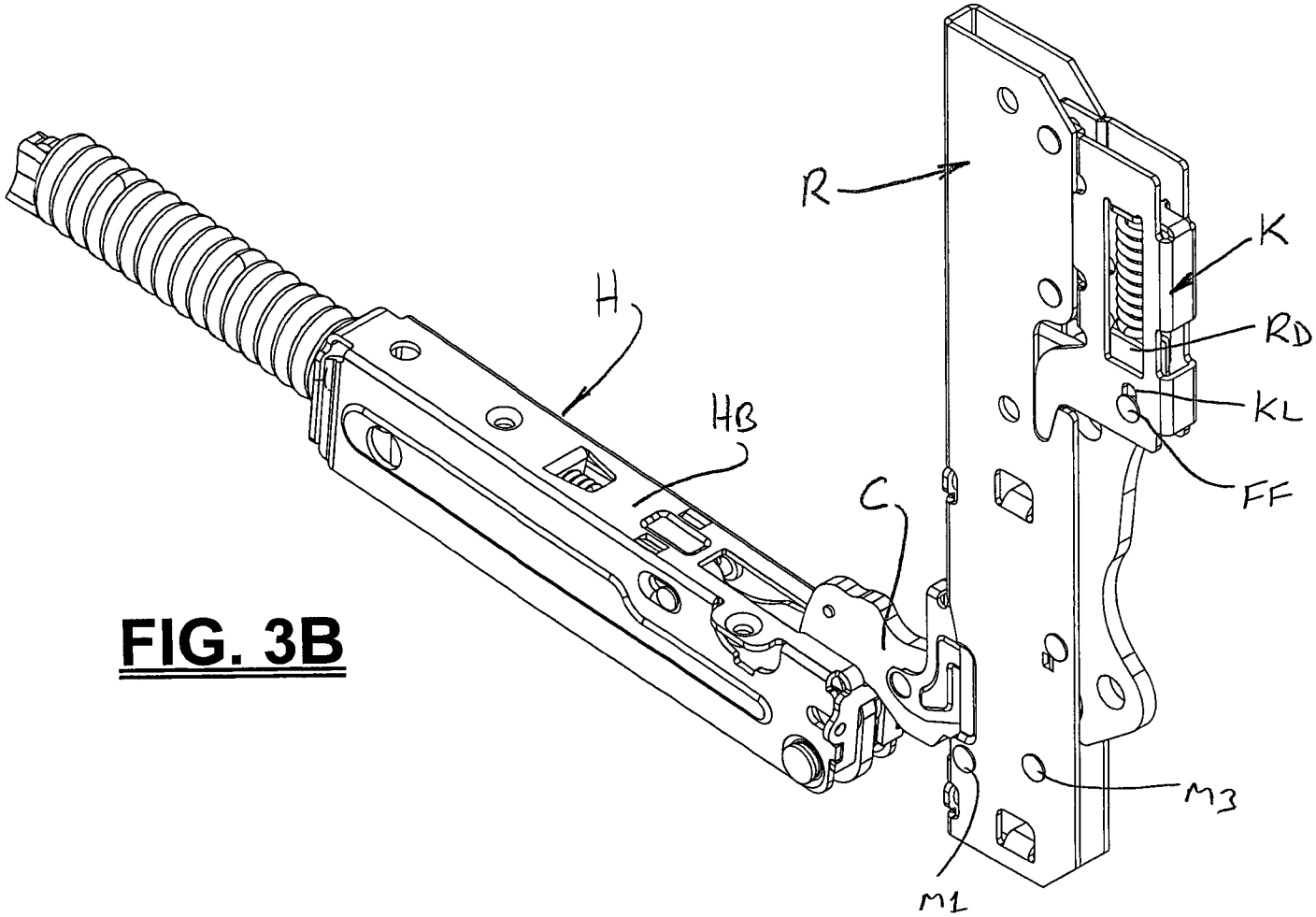
FIG. 3B is similar to FIG. 3A but is a rear isometric view.
Figure 4:
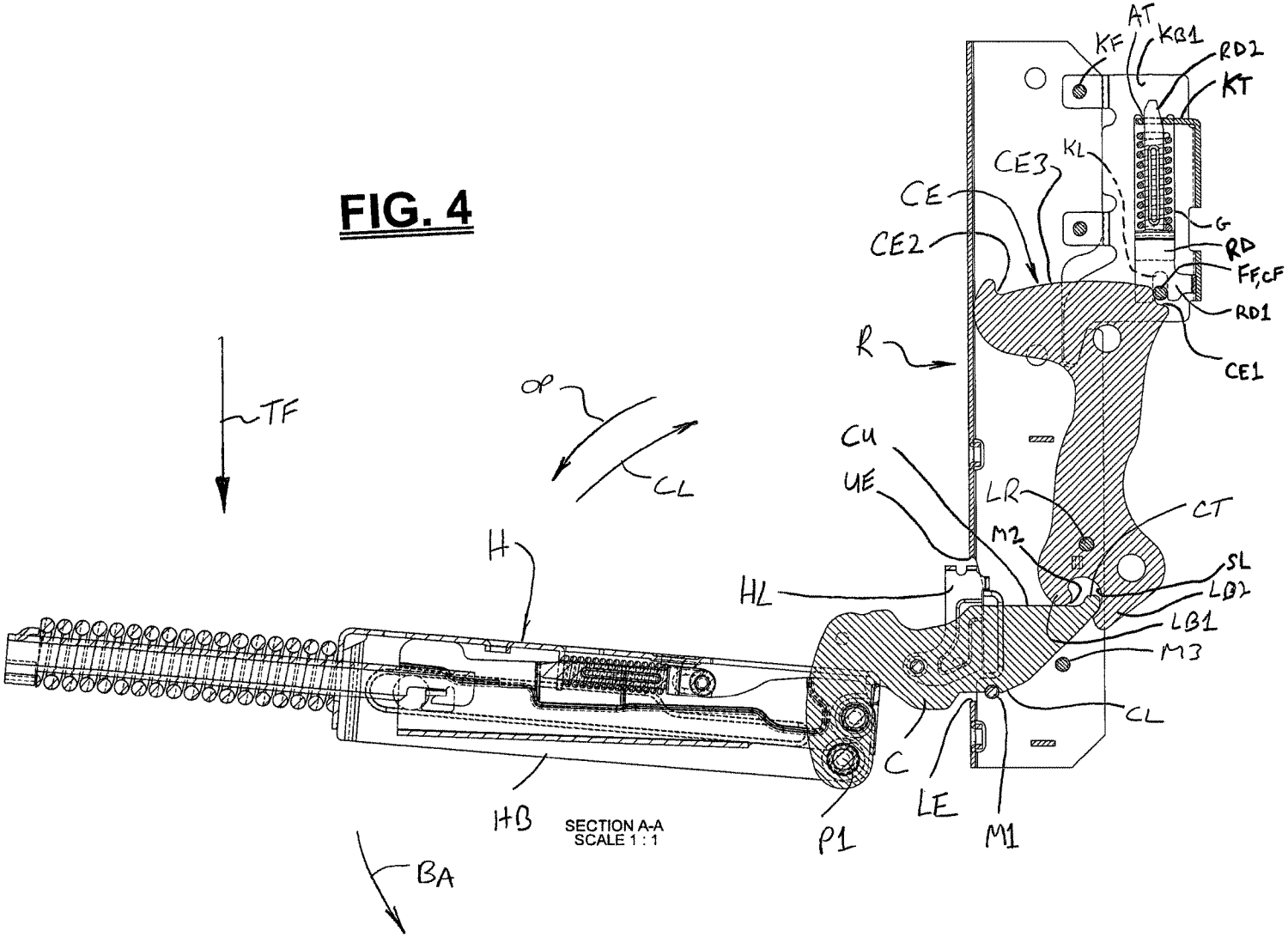
FIG. 4 is a section view of the breakaway receptacle with an associated hinge assembly operably mated therewith, with the breakaway receptacle in its normal operative position.

FIGS. 3A & 3B are respectively similar to FIGS. 2A & 2B, but show the hinge arm C of an associated hinge assembly H1,H2 (generally indicated by the identifier "H") mated with the breakaway receptacle R. The hinge assembly H comprises a hinge body HB that is pivotally connected to the hinge arm C by a pivot fastener P1 and to which the appliance door OD (shown partially in broken lines in FIG. 3A) is secured so that the appliance door OD moves with the hinge body on an arc A between its closed and opened positions relative to the breakaway receptacle R and relative to the appliance body OB to which the breakaway receptacle R is fixedly secured. FIG. 4 is a section view of the breakaway receptacle R with an associated hinge assembly H operably mated therewith, with the breakaway receptacle R in its normal operative position.

The exact mating arrangement between hinge arm C and the breakaway receptacle R can vary without departing from the overall scope and intent of the present development. In the illustrated embodiment, the front wall S3 of the breakaway receptacle R defines an opening P adapted to receive the hinge arm C of the hinge assembly H1,H2 therethrough into the space SP defined between the first and second side walls S1,S2. Referring specifically to FIG. 4, the breakaway receptacle R comprises first and second mounting locations or structures M1,M2 between which the hinge arm C is received and captured so that the hinge arm C can be inserted and removed only by first lifting the hinge assembly H and guiding a tip CT of the hinge arm C into the desired location between the mounting locations M1,M2 as shown in FIG. 4. When installed, a lower edge CL of the hinge arm C is supported on the first mounting structure M1 and the opposite, upper edge CU of the hinge arm C and/or the tip CT is abutted with the second mounting structure M2. In the illustrated embodiment, a guide structure M3 serves only to guide insertion of the hinge arm C between the first and second mounting structures M1,M2, but it can alternatively be used to support the hinge arm C. The hinge assembly H includes a hinge latch HL pivotally connected to the hinge arm C and that selectively pivots to the engaged position shown in FIG. 3 in order to lie adjacent the upper edge UE of the receptacle opening P so that abutment of the latch HL with the upper edge UE limit upward movement of the hinge arm C toward the upper edge UE sufficiently to prevent disengagement of the hinge arm C from the first and second mounting structures M1,M2 so that the hinge arm C cannot be withdrawn from the receptacle opening P. The hinge assembly latch HL can be manually pivoted to a disengaged position where it does not block upward movement of the hinge arm C toward the upper edge UE as required to withdraw the hinge arm from the receptacle opening P.

The first mounting structure M1 is provided by a rivet, pin, tab, fastener or other mounting structure that is connected to and or provided by part of the base B and that is fixed in position relative to the base B. As shown in FIGS. 2A-4, the first mounting structure M1 is defined by a rivet located adjacent the lower edge LE of the opening P and spanning the space SP between the side walls S1,S2. In an alternative embodiment, the lower edge LE, itself, provides or defines the first mounting structure M1 of the breakaway receptacle R.

Similarly, the guide structure M3, if provided, is provided by a structure such as a rivet, pin, tab, fastener or other structure that is connected to and or provided by part of the base B. As shown, the guide structure M3 comprises a rivet that spans the space SP between the side walls S1,S2.

Figure 5A:
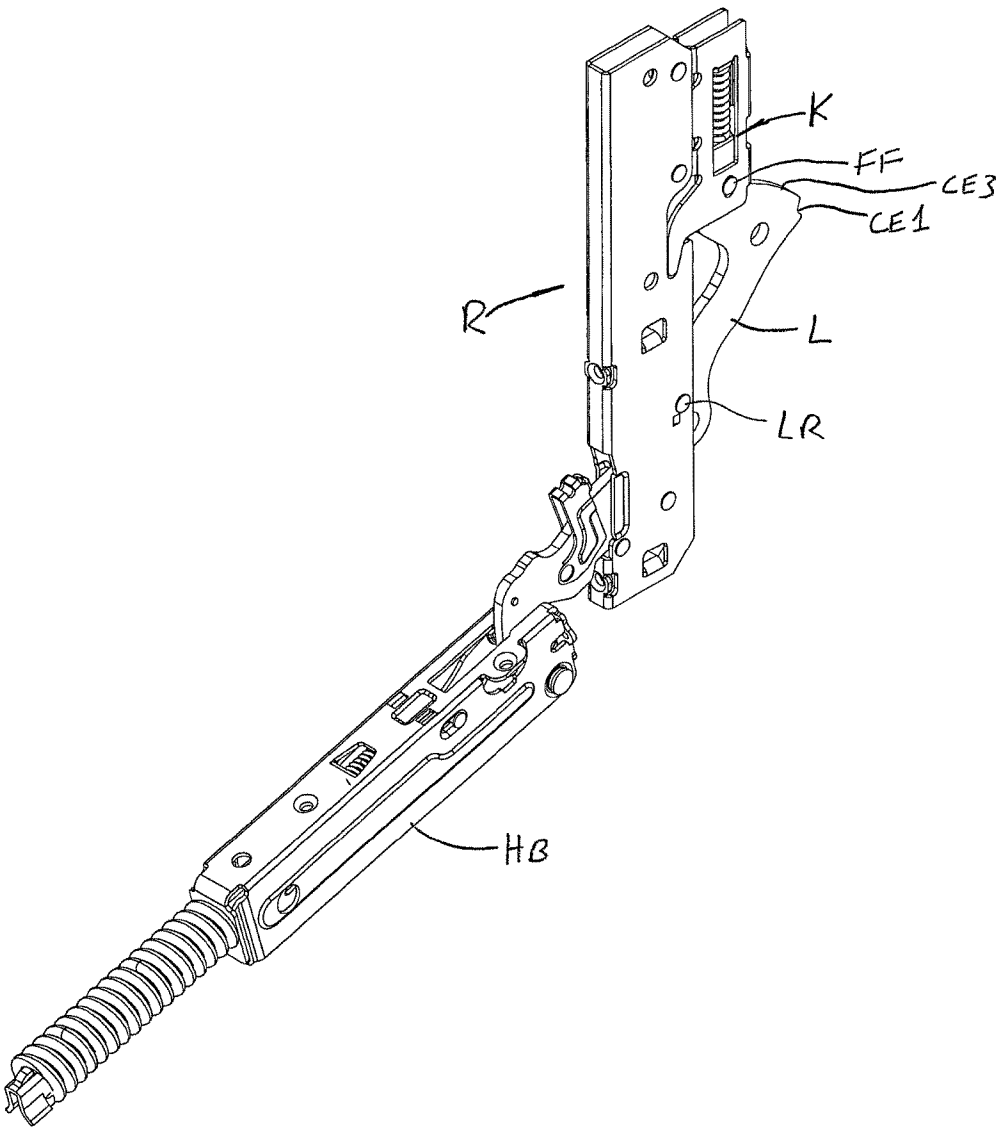
FIG. 5A is similar to FIG. 3A but shows the hinge assembly moved to a breakaway position relative to the receptacle as caused by excessive force exerted on the hinge assembly when in its door-opened position and shows the receptacle in its breakaway position.
Figure 5B:
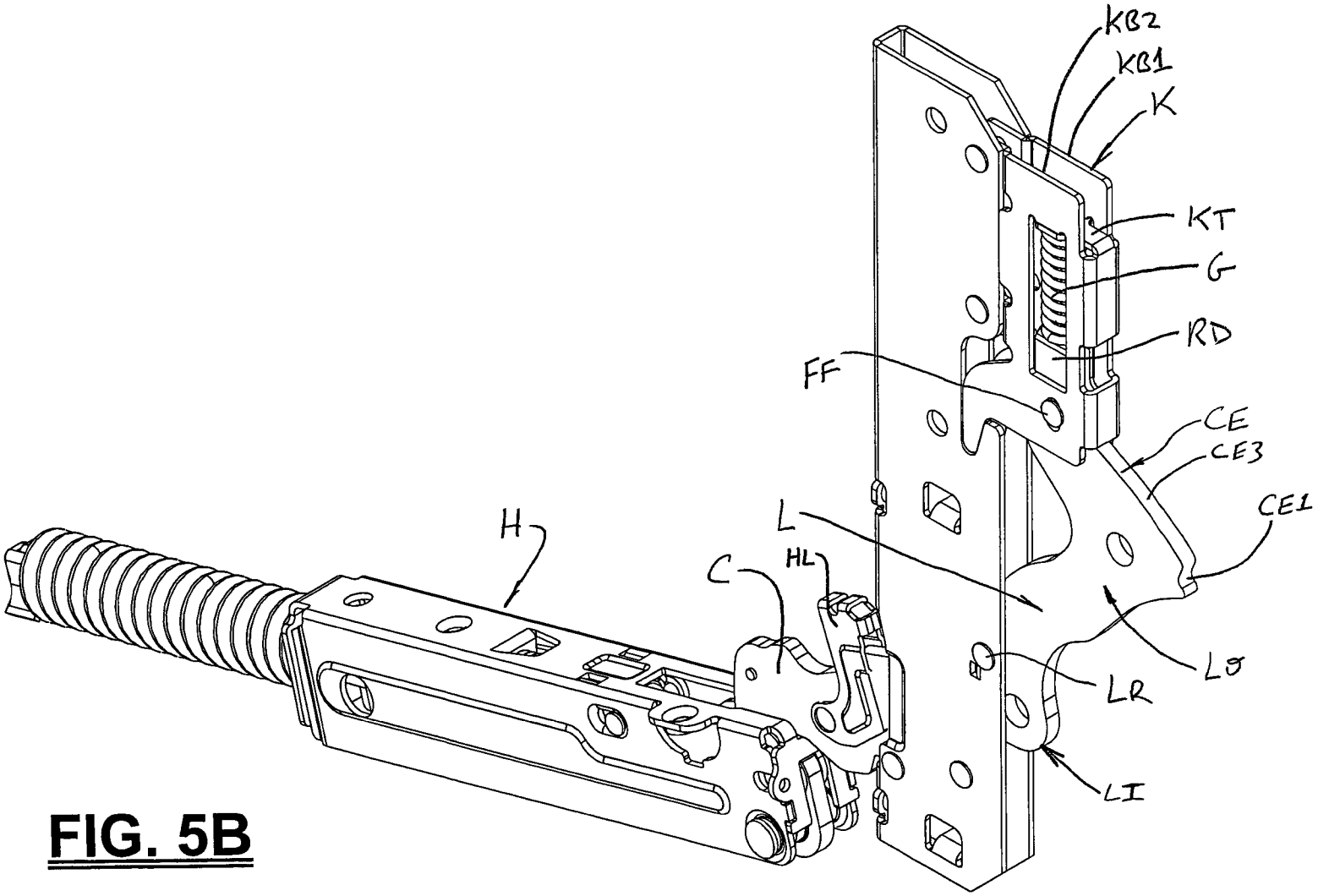
FIG. 5B is similar to FIG. 5A but is a rear isometric view.
Figure 6:
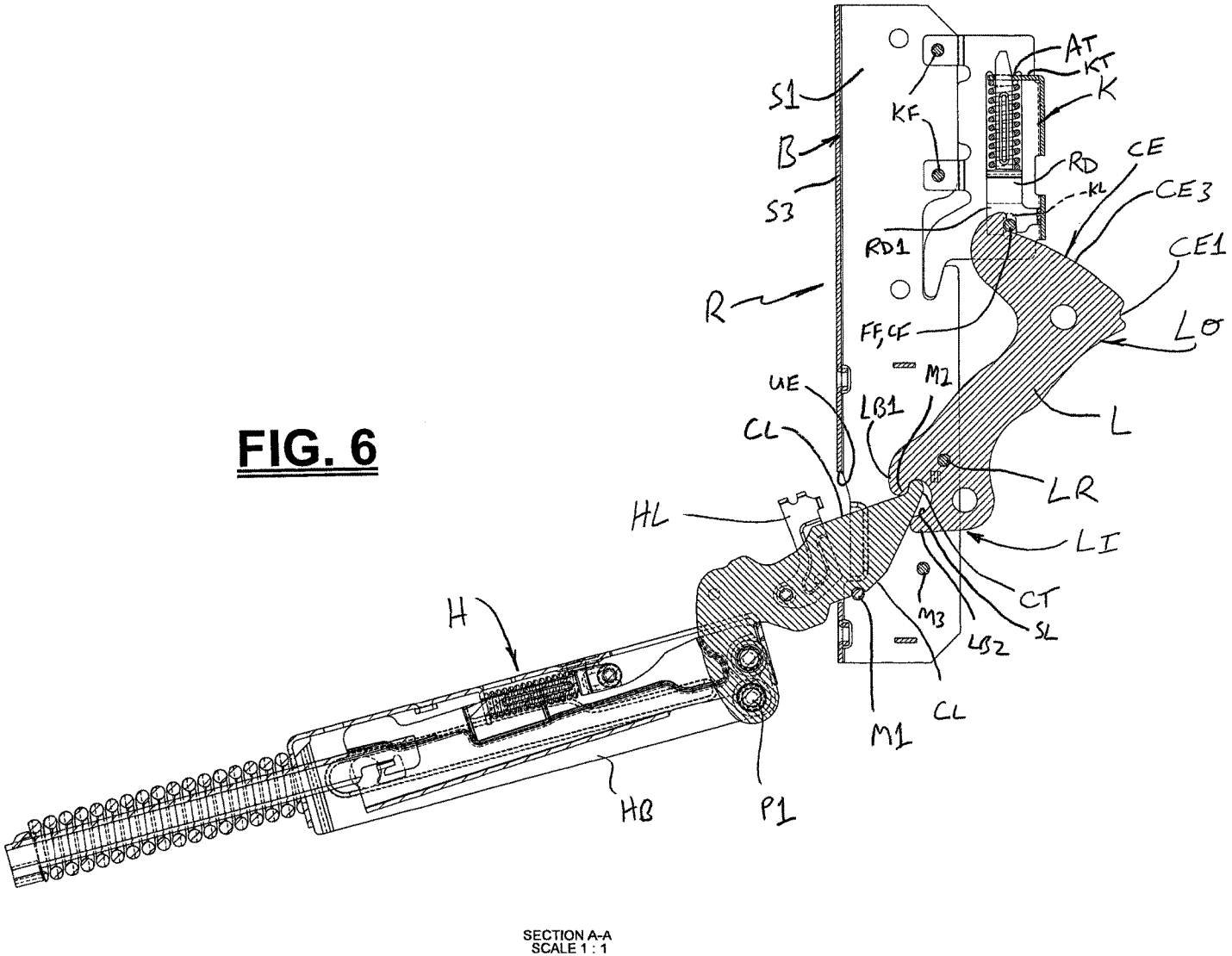
FIG. 6 is a section view of the breakaway receptacle and hinge assembly, with the breakaway receptacle in its breakaway position and the hinge assembly moved to its breakaway position relative to the receptacle.

The second mounting structure M2 is movably connected to the base B and moves relative to the base B and relative to the first mounting structure M1 between a normal or operative position and a breakaway position. In the illustrated embodiment, the second mounting structure M2 is defined by or otherwise connected to an inner end LI of a movable breakaway lever L that is movably connected to the base B as described below. More particularly, the receptacle R comprises a breakaway lever L that is at least partially located in the space SP between the first and second side walls S1,S2. The lever L is pivotally or otherwise movably connected to the base B by suitable means such as a pivot fastener such as a rivet LR or other fastener such as a pin, screw, bolt, or by any other suitable mounting structure. The lever L comprises an inner (first) end LI located closest to the first mounting structure M1 and an outer (second) end LO located opposite the first end LI. The lever L is pivotally connected to the base B between its inner and outer ends LI,LO by the lever pivot fastener LR and is selectively pivotally movable between an operative (first) position as shown in FIGS. 2A-4 and a breakaway (second) position as shown in FIGS. 5A-6. The second mounting structure M2 is connected to and/or provided or defined by the inner end LI of the breakaway lever L. In the illustrated embodiment, the inner end LI of the lever L comprises a slot SL defined between first and second lobes LB1,LB2, and at least a portion of the first lobe LB1 provides or defines the second mounting structure M2 and the slot SL accommodates the tip CT of the hinge arm C when the hinge arm C is operatively connected to the receptacle R. The second lobe LB2 preferably contacts the hinge arm tip CT and/or the lower edge CL of the hinge arm C and thus serves to stabilize the hinge arm C in the receptacle R and also serves to control movement of the hinge arm C and breakaway lever L when the receptacle is reset from its breakaway position back to its operative position as described in more detail below. Alternatively, the second mounting structure M2 is defined by a separate structure that is movable relative to the base B and directly or indirectly connected to the base B and/or lever L. Those of ordinary skill in the art will recognize that the second mounting structure M2 is "connected" to the lever L when the second mounting structure M2 is defined or provided by a portion of the lever L, itself, and also when the second mounting structure M2 is defined or provided by a separate structure that is then connected, directly or indirectly, to the lever L.

The opposite, outer end LO of the breakaway lever L comprises a cam edge CE. The cam edge CE includes an operative or "home" location CE1, a breakaway location or dwell location CE2, and a smoothly curved transition surface CE3 that extends between and connects the operative home location CE1 to the breakaway dwell location CE2. The receptacle R further comprises a breakaway cam latch or breakaway latch mechanism K connected to or provided as part of the base B and operative to engage the cam edge CE of the breakaway lever L to hold the lever L in its operative position (FIGS. 2A-4) until sufficient breakaway or tipping force is applied to the appliance door OD and hinge assembly body HB to cause the hinge arm C to urge the breakaway lever L from its operative position to its breakaway position against the holding or biasing force of the breakaway latch K.

The breakaway latch K comprises a latch base KB that is connected and/or formed as part of the receptacle base B. As shown, the latch base KB is constructed separate from the receptacle base B and connected thereto by rivets or other fasteners KF or by welding or other means. The latch base KB comprises first and second spaced-apart side walls or tabs KB1,KB2 between which a spring rod RD is slidably connected and adapted for sliding reciprocation along an axis that lies transverse to the transition surface CE3 of the breakaway lever cam edge CE. The side walls KB1,KB2 comprises respective elongated slots KL that are aligned with each other. The spring rod RD comprises a first end RD1 that is slidably connected between the side walls KB1,KB2 by a rivet, pin, or other follower fastener FF that extends between the side walls K1,K2 and through the aligned slots KL so as to be reciprocally slidable in the slots KL. The latch base KB also comprises a transverse wall or tab KT located between the side walls KB1,KB2 and spaced from the slots KL. A second end RD2 of the spring rod RD extends through an aperture AT (FIGS. 4 & 6) defined in the tab KT so that the second end RD2 of the spring rod RD is slidably captured and adapted to reciprocate in the space between the side walls KB1,KB2. The latch K further comprises a mechanical, fluid and/or other type of spring or other means for biasing the spring rod RD to an extended position, i.e., for biasing the first end RD1 of the spring rod RD away from the tab KT toward the cam edge CE of the breakaway lever L. In the illustrated embodiment, a coil spring G coaxially positioned about the spring rod RD and is located between the tab KT and the first end RD1 of the spring rod RD to bias the first end RD1 of the spring rod toward the breakaway lever L.

In the illustrated embodiment, the follower fastener FF is shown as a simple rivet, and the follower fastener FF, itself, acts as a cam follower CF for engaging the cam edge CE of the breakaway lever L. Alternatively, the follower fastener FF comprises an optional roller, bushing, slide member, or other follower member or follower element connected thereto or formed as a part thereof and located between the latch body side walls KB1,KB2 for engaging the cam edge CE of the breakaway lever L, in which case the cam follower CF comprises the follower fastener and the separate follower element or follower member connected to the follower fastener FF. In either case, the breakaway latch K comprises a cam follower CF connected to the first end RD1 of the spring rod RD, and the breakaway lever L is located relative to the breakaway latch K such that the cam follower CF continuously contacts and engages the cam edge CE of the breakaway lever L. The coil spring G is coaxially positioned about the spring rod RD and is located between the tab KT and the cam follower CF to continuously bias the cam follower CF into engagement and abutment with the cam edge CE such that the cam follower CF exerts a biasing force on the breakaway lever L for controlling the movement and position thereof as described further below.

Operation of the breakaway hinge receptacle R is further described with primary reference to FIGS. 4 & 6. FIG. 4 shows the hinge assembly H operatively mated with the receptacle R, with the receptacle R in its operative position, i.e., with the breakaway lever L in its normal or home position. The cam follower CF is located in the operative location CE1 and biased by the latch spring G into such position so that the breakaway lever L is held in its operative position. The hinge assembly H is in its fully opened operative position corresponding to a fully opened position of the appliance door OD. The appliance door OD can be closed by pivoting movement of the hinge body HB about a pivot fastener P1 of the hinge assembly H in the direction CL and can be moved from the closed position (not shown) to the opened position by movement in the opposite direction OP about the pivot fastener P1.

In case excessive weight or other breakaway or tipping force TF is exerted on the appliance door OD that would damage the hinge assembly H and/or mounting receptacle R and/or that would tip the related appliance O, the tipping force TF causes the hinge arm C to rotate about the first mounting structure M1 relative to the receptacle R with sufficient breakaway force so that the hinge arm C and its tip CT move the breakaway lever L and the second mounting structure M2 from their respective operative positions (FIG. 4) to their respective breakaway positions (FIG. 6) against the biasing force of the cam follower CF acting on the operative location CE1 of the cam edge CE. The tipping force TF causes rotation of the hinge assembly H and its hinge arm C in the direction BA and causes rotation of the breakaway lever L from its normal position toward its breakaway position until the cam follower CF seats in the breakaway dwell location CE2, at which time the breakaway lever L is deemed to be in its breakaway position or full breakaway position. Between the operative position of the lever L (FIG. 4) and the breakaway position of the lever L (FIG. 6), the lever L moves through an intermediate position or intermediate breakaway position in which the cam follower CF is engaged with and moves along the transition surface CE3 of the cam edge CE. The contour of the transition surface CE3 can be varied to control the forces exerted on the breakaway lever L by the cam follower CF, i.e., the shape of the transition surface CE3 can be varied to control whether or not and the degree to which the cam follower CF urges the breakaway lever L toward its breakaway position or toward its operative position after the initial application of tipping force TF sufficient to dislodge the cam follower CF from the operative dwell location CE1. Likewise, the shape of the cam edge CE at the operative location CE1 and/or along the transition surface CE3 can be varied to alter the force required to move the breakaway lever L from its operative position to its breakaway position to control the minimum tipping force TF required to move the breakaway lever L and the second mounting location M2 to their respective breakaway positions.

As shown, the breakaway dwell location CE2 is shaped such that the cam follower CF can be dislodged therefrom by reversing the tipping force TF so that the tip CT of the hinge arm C acts on the breakaway lever L and urges same back to its operative position to reset the breakaway receptacle R. In one embodiment, the breakaway dwell location CE2 and the transition surface CE3 are conformed so that the breakaway lever L automatically moves or "resets" to its operative position when the tipping force TF abates due to the forces exerted on the lever L by the biasing spring G through the cam follower CF. In an alternative embodiment, the breakaway dwell location CE2 can be made sufficiently deep, hooked, or otherwise conformed so that the breakaway lever L cannot be reset to its operative position by simple reversal or removal of the tipping force TF so that a service technician or other user would need to take additional action to dislodge the cam follower CF from the breakaway dwell location CE2 and move the breakaway lever L from its breakaway position to its operative position in order to reset the breakaway receptacle R.

Figure 7:
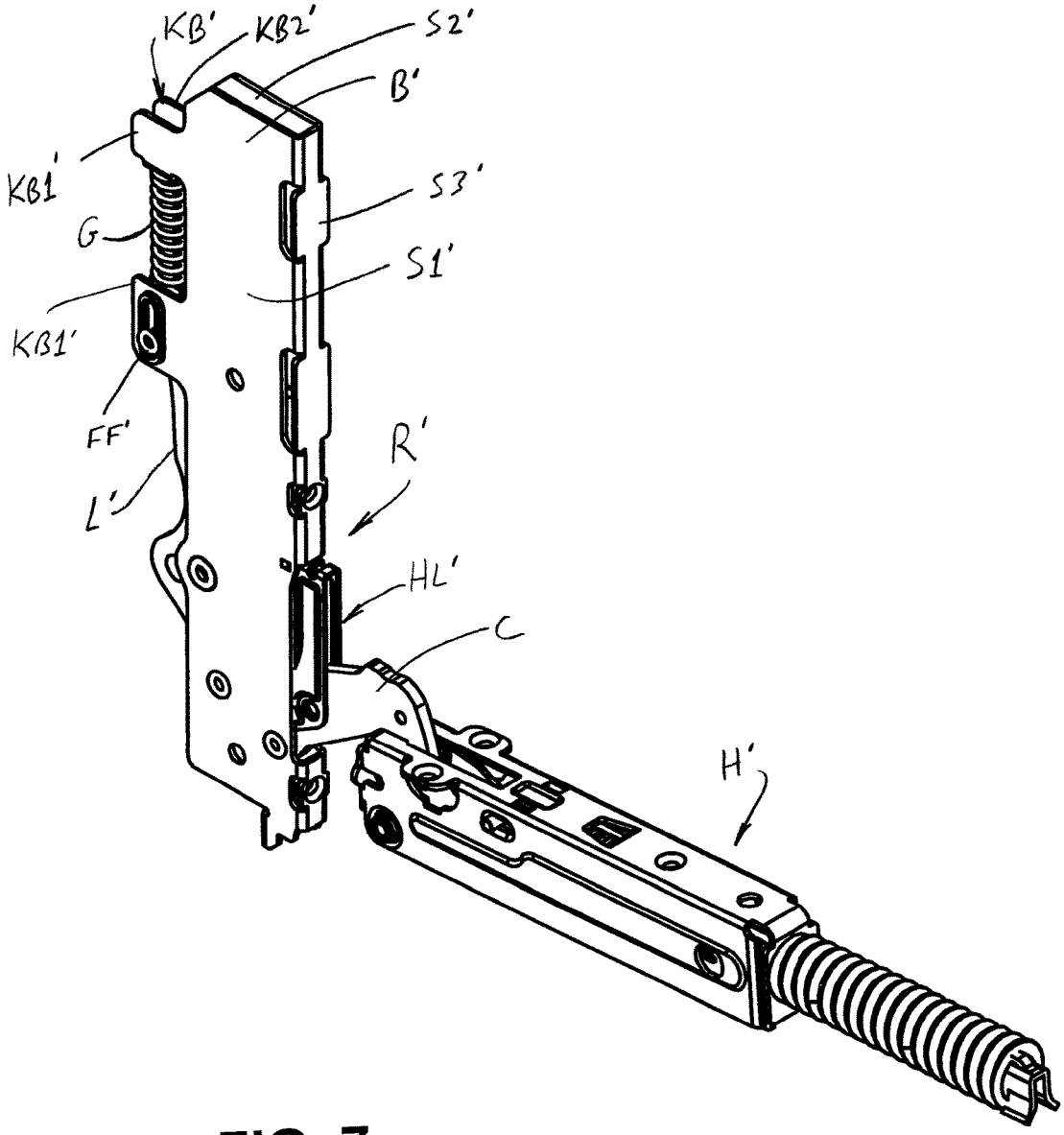
FIG. 7 is an isometric view of a breakaway hinge receptacle formed in accordance with an alternative embodiment, with an associated hinge assembly mated therewith.
Figure 7A:
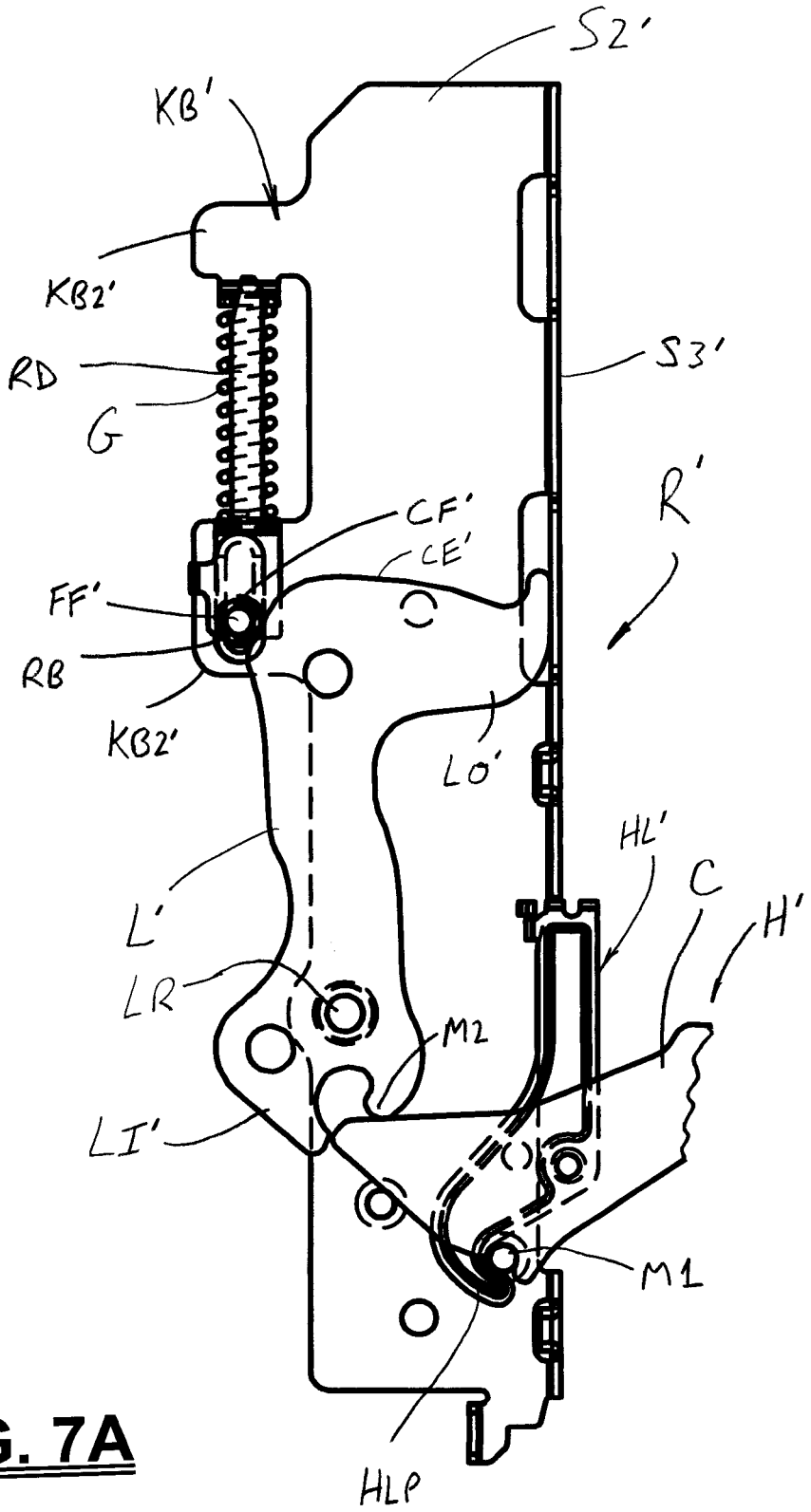
FIG. 7A is a section view of the alternative embodiment breakaway receptacle of FIG. 7 arranged in its normal operative position.

FIG. 7 is an isometric view of a breakaway hinge receptacle R' formed in accordance with an alternative embodiment and arranged in its normal operative position, with an associated hinge assembly H' mated therewith. FIG. 7A is a section view of the alternative embodiment breakaway receptacle R' of FIG. 7, with the hinge assembly H' only partially shown. Except as otherwise shown and/or described herein. The breakaway hinge receptacle R' is identical to the breakaway hinge receptacle R, and corresponding components are identified using corresponding reference characters, except that modified components are identified with corresponding reference characters including a primed (') modifier. The receptacle R' differs from the receptacle R in that the latch base KB' of the breakaway latch L is connected to the receptacle base B' by being defined as a part of the receptacle base B' as a one-piece construction instead of being a separate component that is secured to the receptacle base B'. The first and second spaced-apart side walls KB1',KB2' of the latch base KB' (which each include tabs separated by open or cutout regions) are defined by extended portions of the receptacle base side walls S1',S2', respectively. Additionally, FIG. 7A shows that the cam follower CF' comprises an optionally roller or bushing RB coaxially supported on the follower fastener FF' between the latch base side walls KB1',KB2' and engaged with the cam edge CE' (the cam edge CE' also has a differently shaped profile as compared to the cam edge CE).

FIGS. 7 and 7A also show that the associated hinge assembly H' includes an alternative hinge latch HL' pivotally connected to the hinge arm C. Unlike the hinge latch HL described above, the hinge latch HL' further includes a hook portion HLP (FIG. 7A) that captures the hinge arm C to the first mounting structure M1 by at least partially wrapping around the first mounting structure M1 when the hinge arm C is mated with the receptacle R' and the hinge latch HL' is located in its engaged position as shown in FIGS. 7 and 7A. When the hinge latch HL' is located in the illustrated engaged position, the hinge arm C is still able to rotate relative to receptacle about the first mounting structure M1 as needed for the hinge arm C to move the breakaway lever L' from its operative position (shown) to its breakaway position in response to excessive force being exerted on the hinge assembly H as described above, but the hinge arm C is captured to the first mounting structure M1 and cannot be separated from the receptacle R' while the hinge latch HL' is engaged. The hinge latch HL' is selectively manually movable to a disengaged position where the hook portion HLP is spaced from the first mounting structure M1 of the receptacle R' so that the hook portion HLP no longer captures the hinge arm C to the first mounting structure M1 and the hinge arm C can be separated from the receptacle R'.

The following claims should be construed as broadly as legally possible while maintaining their validity in order to encompass variations, alternatives, modifications, improvements, equivalents, and substantial equivalents of the embodiments and teachings disclosed herein.

The invention claimed is:

1. A breakaway receptacle for an associated appliance hinge, said receptacle comprising:

a receptacle base;

a breakaway lever movably connected to the receptacle base, wherein said breakaway lever comprises an inner end and an outer end spaced apart from each other, and said breakaway lever is pivotally connected to said receptacle base by a pivot fastener located between said inner end and said outer end of said breakaway lever such that said inner and outer ends of the breakaway lever are selectively rotatable about said pivot fastener, said outer end of said breakaway lever comprising a cam edge;

a first mounting structure connected to the receptacle base and adapted to be engaged by a lower edge of an associated hinge arm;

a second mounting structure provided by said inner end of said breakaway lever such that said second mounting structure is part of and movable with said inner end of said breakaway lever when said breakaway lever rotates about said pivot fastener relative to the receptacle base, said second mounting structure adapted to be engaged by an upper edge of the associated hinge arm;

a breakaway latch connected to the receptacle base, said breakaway latch comprising: (i) a latch base including first and second spaced apart side walls and a transverse wall, said first and second side walls respectively including elongated slots defined therein that are aligned with each other; (ii) a spring rod located between the first and second side walls and adapted for sliding reciprocation, wherein said spring rod extends through an aperture defined in said transverse wall and is slidably connected to said latch base; (iii) a cam follower connected to said spring rod, said cam follower comprising a follower fastener that is engaged with the spring rod and that extends between said first and second side walls and through the aligned elongated slots defined respectively therein; and (iv) a spring coaxially positioned about said spring rod such that said spring biases said cam follower into abutment with said cam edge;

said breakaway lever selectively rotatable relative to said receptacle base about said pivot fastener when a breakaway force is exerted on said inner end of said breakaway lever through said second mounting structure from a first position where said cam follower is engaged with a home location on said cam edge to a second position where said cam follower is engaged with a breakaway dwell location on said cam edge, said cam edge further comprises a transition surface that extends between the home location and the breakaway dwell location, wherein said cam follower is in contact with said transition surface when said breakaway lever is located between said first position and said second position.

2. The breakaway receptacle as set forth in claim 1, wherein said second mounting structure comprises a slot defined in the inner end of the breakaway lever that is adapted to accommodate a tip portion of the associated hinge arm.

3. The breakaway receptacle as set forth in claim 2, wherein said inner end of said breakaway lever comprises first and second lobes between which said slot is defined, wherein said second mounting structure is provided by at least said first lobe.

4. The breakaway receptacle as set forth in claim 1, wherein said follower fastener contacts and engages said cam edge of said breakaway lever when said breakaway lever rotates from its first position to its second position.

5. The breakaway receptacle as set forth in claim 4, wherein said latch base and said receptacle base are defined together as a one-piece construction.

6. The breakaway receptacle as set forth in claim 1, wherein said cam follower comprises said follower fastener and at least one of a roller, a bushing, or a slide member that is connected to said follower fastener and that is engaged with said cam edge.

7. The breakaway receptacle as set forth in claim 6, wherein said latch base and said receptacle base are defined together as a one-piece construction.

8. The breakaway receptacle as set forth in claim 1, wherein said coil spring is coaxially positioned about said spring rod between said transverse wall of said latch base and said cam follower.

9. The breakaway receptacle as set forth in claim 8, wherein said latch base and said receptacle base are defined together as a one-piece construction.

* * * * *